US008372486B2

(12) United States Patent
Bell et al.

(10) Patent No.: US 8,372,486 B2
(45) Date of Patent: Feb. 12, 2013

(54) LUBRICATED METAL ARTICLE

(75) Inventors: Gregory A. Bell, New Castle, DE (US); Jon Lee Howell, Bear, DE (US); Clay Woodward Jones, Washington, WV (US); Robert Clayton Wheland, Wilmington, DE (US)

(73) Assignee: E I du Pont de Nemours and Company, Wilmington, DE (US)

( * ) Notice: Subject to any disclaimer, the term of this patent is extended or adjusted under 35 U.S.C. 154(b) by 513 days.

(21) Appl. No.: 11/958,171

(22) Filed: Dec. 17, 2007

(65) Prior Publication Data

US 2008/0176774 A1 Jul. 24, 2008

Related U.S. Application Data

(60) Provisional application No. 60/871,333, filed on Dec. 21, 2006.

(51) Int. Cl.
*B05D 1/36* (2006.01)
*B05D 7/14* (2006.01)
*B32B 27/00* (2006.01)

(52) U.S. Cl. ..... 427/388.1; 428/421; 428/422; 428/543; 508/106; 508/582; 508/590

(58) Field of Classification Search ..... 508/130; 526/206; 428/336
See application file for complete search history.

(56) References Cited

U.S. PATENT DOCUMENTS

| | | | | |
|---|---|---|---|---|
| 2,907,795 | A | 10/1959 | Woff | |
| 5,478,905 | A | 12/1995 | Anolick et al. | |
| 5,637,663 | A | 6/1997 | Anolick et al. | |
| 5,663,255 | A | 9/1997 | Anolick et al. | |
| 6,133,389 | A | 10/2000 | Anolick et al. | |
| 6,596,829 | B1 * | 7/2003 | Peavy | 526/250 |
| 6,767,626 | B2 * | 7/2004 | Tuminello et al. | 428/336 |
| 2006/0079600 | A1 * | 4/2006 | Gopalratnam et al. | 523/139 |
| 2006/0079601 | A1 * | 4/2006 | Gullo et al. | 523/139 |
| 2008/0154000 | A1 * | 6/2008 | Howell et al. | 526/206 |

FOREIGN PATENT DOCUMENTS

| | | | |
|---|---|---|---|
| WO | 88/08007 | A1 | 10/1988 |
| WO | 01/87801 | A | 11/2001 |

OTHER PUBLICATIONS

European Search Report Dated Apr. 21, 2008 for European Patent Application No. 07255027.0.

* cited by examiner

*Primary Examiner* — Ellen McAvoy
*Assistant Examiner* — Latosha Hines

(57) ABSTRACT

Liquid hydrofluorocarbons provide low corrosivity lubrication of metallic surfaces especially at elevated temperatures.

17 Claims, 1 Drawing Sheet

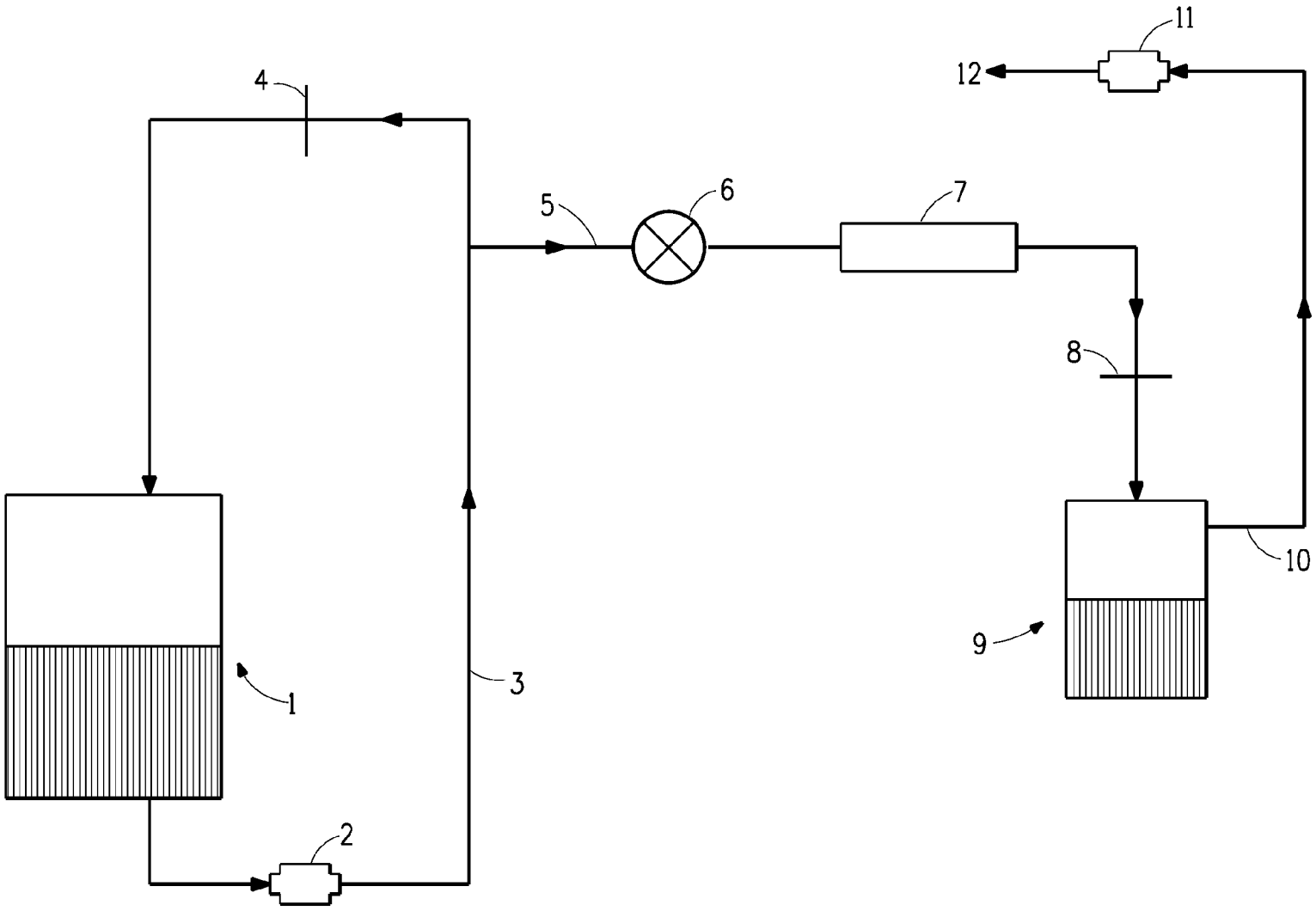
1
2
3
4
5
6
7
8
9
10
11
12

LUBRICATED METAL ARTICLE

FIELD OF THE INVENTION

The present invention is directed to the use of hydrofluorocarbon co-telomers for lubricating metals at elevated temperatures.

BACKGROUND

Fluorinated oils and greases are employed as lubricants in demanding applications. A well-known class of fluorinated lubricants are the perfluoroalkylpolyether oils available as commercial products under the tradenames KRYTOX® (E. I. du Pont de Nemours and Company, Wilmington Del.), FOMBLIN® (Ausimont, Milan, Italy), and DEMNUM® (Daiken Industries, Japan). It is found in practice that in oxygen containing environments, the perfluoroalkylpolyethers may undergo degradation at temperatures as low as 150° C., with concomitant corrosion of some metal surfaces such as aluminum, iron and alloys thereof. There is a need for lubricating oils with improved stability at elevated temperature that results in less corrosion of a lubricated metal surface.

Anolick et al., in U.S. Pat. Nos. 5,478,905, 5,663,255, 5,637,663, and 6,133,389, describes a continuous co-telomerization process comprising contacting a large excess of hexafluoropropylene with fluoro-olefins such as tetrafluoroethylene (TFE)and vinylidene fluoride ($VF_2$) and a radical initiator under a pressure of about 41 to about 690 MPa, and a temperature above about 200° to about 400° C. to produce amorphous cotelomers. Also described was the equipment for conducting the cotelomerization with a residence time of about 10 s to about 30 min.

Tuminello et al., U.S. Pat. No. 6,767,626, discloses use of high HFP content co-telomers for protection of stone surfaces

SUMMARY OF THE INVENTION

The present invention provides a method comprising: contacting a metallic surface with an amorphous liquid hydrofluorocarbon co-telomer comprising 30-65% of monomer units derived from hexafluoropropylene and characterized by an H:F molar ratio in the range of 0.05 to 1.

DESCRIPTION OF THE FIGURE

An apparatus used according to an embodiment of the invention to prepare the co-telomeric hydrofluoroolefins according to the process is shown schematically in FIG. 1.

DETAILED DESCRIPTION

For the purposes of the present disclosure the term "co-telomer" shall be understood to mean one or more members of a homologous series of liquid hydrofluorocarbons synthesized by the process described infra wherein the use of chain transfer agents serves to limit the molecular weight of the co-telomer formed.

The present invention provides methods for lubricating metallic surfaces especially at elevated temperatures using co-telomers comprising 30-65 mol-% of monomer units derived from hexafluoropropylene (HFP) the HFP being present at sufficient concentration to prevent crystallization of the co-telomer thereof. The methods can provide reduced corrosion of metal surfaces as compared to conventional lubricating methods. The co-telomeric liquids produced represent a distillable homologous series of fractions some of which are quite low in viscosity others much higher.

The operability of the present methods is not limited by manner in which the hydrofluorocarbon co-telomer employed therein is prepared. However, it is found that a suitable hydrofluorocarbon co-telomer is conveniently prepared in a process comprising forming a reaction mixture by combining 80-99 weight-% of HFP, preferably 90-97 weight-%, 1-20 weight-%, preferably 3-10 wt-%, of an olefinically unsaturated co-monomer, 0.05 to 2 weight-%, preferably 0.05-0.8 weight-% of a free-radical initiator, and 0.25 to 5 weight-%, preferably 0.5-1 weight-%, of a chain transfer agent; preferably a non-monomeric chain transfer agent, causing the free-radical initiator to initiate a free-radical co-telomerization; and causing the reaction mixture to undergo free radical co-telomerization at a temperature in the range of 225 to 400° C., a pressure of 40-700 MPa (5.8 to 100 kpsi), for a period of 1 second to 60 minutes, to form an amorphous hydrofluorocarbon liquid co-telomer comprising 30-65% of monomer units derived from HFP the liquid co-telomer and characterized by a H:F molar ratio in the ranqe of 0.05 to 1.

The resulting mixture of co-telomers may conveniently be broken into two components, fluorohydrocarbon lubricating oil and fluorohydrocarbon volatile fluids. The fluorinated volatile fluids are useful as solvents for co-telomers and as degreasers, but because of their volatility they are not well suited for lubrication applications at elevated temperatures.

The volatile fluids are preferably distilled off between about 40 and 200° C. at pressures ranging from atmospheric to 0.1 torr (13 Pa). The term "lubricating oil" shall refer to that part of the product that is left behind in the distillation pot after distillation. The oil boils above about 100 to 200° C. when under a vacuum of about 0.1 to 3 torr (13 to 400 Pa). It is this residual oil or, if necessary, still higher boiling cuts, that are suitable for use as the hydrofluorocarbon co-telomeric lubricating oil according to the present invention.

A lubricating oil produced according to a processes of the present invention is an amorphous perfluorohydrocarbon or a partially fluorinated hydrocarbon, comprising 30 to 65 mol-%, preferably 40 to 60 mol-%, of monomer units of HFP, and a C—H/C—F backbone bond ratio of from 0.05 to 1. The viscosity of the oil ranges from 1 to 10,000 cSt at 40° C.

The co-telomerization can be affected in any pressurized apparatus in which the reactant and product streams may be added and removed at appropriate rates. Thus the apparatus may be a stirred or unstirred autoclave, a pipeline type reactor, or other suitable apparatus. It is observed in the practice of the present invention that agitation of the reaction mixture reduces polydispersity of the product. The material of construction of the reactor should be suitable for the process ingredients; metals such as stainless steel or Hastelloy® alloy are often suitable. A suitable apparatus is shown schematically in FIG. 1. Because of the high pressures involved and the explosion hazards associated with TFE and VF2, the entire apparatus should be barricaded.

Suitable comonomers for co-telomerization with HFP in the process are characterized by olefinic unsaturation and are co-telomerizable in a free-radical co-telomerization reaction. Suitable comonomers include but are not limited to vinylidene fluoride; perfluoroalkylvinyl ethers of the structure $R_fOCF{=}CF_2$ wherein $R_f$ is a C1-C4 perfluoralkyl radical such as perfluoropropylvinyl ether, perfluoromethylvinyl ether or perfluoroisopropylvinyl ether; ethylene; hexafluoroisobutylene; perfluoroalkylethylenes of the structure $R'_fCH{=}CH_2$ wherein $R'_f$ is a linear C1 to C8 perfluoroalkyl radical such as perfluorobutylethylene (PFBE) or 3,3,3-trifluoropropene (TFP); vinyl fluoride (VF); trifluoroethylene;

tetrafluoroethylene; chlorotrifluoroethylene; and combinations thereof. Vinylidene fluoride; perfluoropropylvinyl ether; ethylene; and tetrafluoroethylene are preferred, with the proviso that the total of the concentrations of vinylidene fluoride, ethylene, and tetrafluoroethylene is <10 weight-%.

Free radical initiators useful in the practice of the present invention include but are not limited to nitrogen trifluoride, di-t-butylperoxide, oxygen, perfluoropiperazine; $R_fNF_2$, $(R_f)_2NF$, $R_fN{=}NR_f$, $R_fOOR_f$, $R_fSO_2R_f$, and $R_fSO_2F$ wherein each $R_f$ is independently a $C_nF_{(2n+1)}$ group, with n=1 to 4, linear or branched, and hindered fluorocarbons of the formula CnF(2n+2), such as are described by Tonelli et al. in WO 88/08007. Hindered fluorocarbons, such as $(CF_3)_2CFC(C_2F_5)_2CF_3$ readily undergo homolytic scission releasing radicals that are free radical initiators suitable for the practice of the present invention. Nitrogen trifluoride and di-t-butylperoxide are preferred.

A "chain transfer agent" is defined herein as an additive or a monomer that first terminates the growth of one co-telomer backbone chain and then reinitiates the growth of a new co-telomer backbone chain. This interruption of chain growth lowers molecular weight. Preferably this transfer of the actively growing radical from one chain to a new chain is achieved with a minimal loss in yield and rate of production.

Chain transfer agents useful in the practice of the present invention can be monomeric or non-monomeric radical formers. Non-monomeric chain transfer agents that cannot be copolymerized effectively separate the composition of the telomer produced in the process of the present invention from the molecular weight, and are therefore preferred. When a co-polymerizable chain transfer agent is employed the composition of the polymer is necessarily linked to the molecular weight since the chain transfer agent is incorporated into the telomer. Suitable non-monomeric chain transfer agents include but are not limited to linear, branched, or cyclic $C_1$-$C_6$ hydrocarbons such as ethane; dialkyl ethers, such as dimethyl ether or diethyl ether; tetrahydrofuran, $FSO_2Cl$, $ClSO_2Cl$, aromatics such as p-xylene and hexafluorobenzene, and siloxanes such as octamethyltrisiloxane. Mixtures of chain transfer agents may also be employed. Other suitable chain transfer agents include perfluoroalkyl iodides such as CF3I or C4F9I, chlorocarbons such as CHCl3 and HCCl3, fluorochlorocarbons such as FCCl3, fluorobromocarbons such as CFBr3, thiols such as CF3SH, sulfonyl chlorides such as FSO2Cl, phosphine PH3, phosphorous pentachloride, silanes such as Cl2SiH(CH3), HBr, IF5, ICl, IBr, I2, Cl2, Br2, CH3OH, (EtO)2P(O)H, cyclopentane, THF, H2S, HI, POCl3, SF5Br, isopropanol, methylcyclohexane, diethylether, dioxane, triethylamine, C6H5CH2Br, CH3(C=O)(C=O)C(CH3)2H, methyl acetate. Vinyl fluoride, methylvinyl ether, ethylene and similar comonomers each tend to limit the molecular weight of the finished telomer by acting as chain transfer agents as well as co-monomers.

There is no limitation to the number of comonomers that can be employed in the process, except as dictated by practicality, just so long as the product contains 30-65% of monomer units derived from HFP and the H:F molar ratio is in the range of 0.05 to 1.

In one preferred embodiment of the present invention, hydrofluorocarbon lubricant oil is prepared by co-telomerizing HFP with $VF_2$. In a further embodiment HFP is co-telomerized predominantly with $VF_2$ and one or more additional monomers. By the term "co-telomerized predominantly" is meant that the relative amounts of the monomers employed in the reaction mixture is such that a higher percentage of monomer units present in the resulting co-telomer are derived from the "predominant" comonomer than from any of the other comonomers. Preferred additional monomers and combinations of monomers in addition to HFP+VF2 include ethylene; TFE; a combination of HFIB and ethylene; HFIB; a combination of PFBE and ethylene; a combination of PMVE and ethylene; a combination of PPVE and ethylene; and PPVE, with the proviso that the total of the concentrations of vinylidene fluoride, ethylene, and tetrafluoroethylene is <10 weight-%.

Thus, for example, contemplated in this embodiment is a lubricant prepared by combining HFP, $VF_2$, and TFE in amounts such that the percentage of monomer units of TFE in the co-telomer so-formed is much lower than that of HFP and $VF_2$.

In another preferred embodiment hydrofluorocarbon lubricant oil is prepared by co-telomerizing HFP and TFE. In a further embodiment, HFP is co-telomerized predominantly with TFE and one or more additional monomers. Preferred additional monomers include PPVE, $VF_2$, hydrocarbon olefins such as ethylene; hydrofluorocarbon olefins such as HFIB, PFBE, 3,3,3-trifluoropropene; fluoroalkylether olefins such as PMVE and PPVE, and chlorotrifluoroethylene, with the proviso that the total of the concentrations of vinylidene fluoride, ethylene, and tetrafluoroethylene is <10 weight-%.

In another preferred embodiment hydrofluorocarbon lubricant oil is prepared by co-telomerizing predominantly with ethylene and one or more additional monomers such as those recited supra, with the proviso that the total of the concentrations of vinylidene fluoride, ethylene, and tetrafluoroethylene is ≦10 weight-%.

There are significant reactivity differences among the numerous olefinically unsaturated monomers suitable for the preparation of the hydrofluorocarbon oil useful in the present invention. Because HFP does not co-telomerize very rapidly, it is only by employing large excesses of HFP in a reaction mixture with TFE, $VF_2$, or ethylene can co-telomers with HFP monomer content of 30 mol-% or greater be produced. TFE, $VF_2$, and ethylene all are known as vigorous co-telomerizers. If excessive amounts of TFE, $VF_2$, ethylene or combinations thereof are employed in the process, there is the possibility of a run-away co-telomerization followed by decomposition with potential for explosion. For these reasons, the total quantity of TFE, $VF_2$, and ethylene in any reaction mixture is desirably maintained to a concentration no greater than 10 weight %, and the ethylene content may not exceed 3 weight-%. Other of the olefinically unsaturated monomers suitable for use herein do not react so vigorously so the total co-monomer content reacted with HFP can by up to ca. 20 weight-%.

Certain combinations lead to higher or lower molecular weight co-telomers, as indicated by a higher or lower fraction of the product as a distillable fraction. For example, a reaction mixture consisting essentially of HFP/VF2/PPVE/ethane or a reaction mixture consisting essentially of HFP/VF2/PFBE/ethane prepared with NF3 initiator tend to produce product with a higher percentage of the distillable fraction than does a reaction mixture consisting essentially of HFP/VF2/diethyl ether initiated with NF3 or di-t-butylperoxide. The proportion of distillable solvent relative to nonvolatile oil is increased by increasing the temperature of the co-telomerization, with temperatures above 300° C. being preferred and above 325° C. being most preferred. The proportion of volatiles is also increased by increasing the concentration of chain transfer agent relative to monomer, by using relatively active chain transfer agents such as ethane and by including monomers such as PFBE, PPVE, and ethylene in the mix.

The hydrofluorocarbon oils suitable for use in the methods disclosed herein can be combined with other materials such are known in the art for the purpose of providing useful lubricant compositions. All such compositions are contemplated as part of the present invention. Thus, the hydrofluorocarbon oil suitable for use in the present invention may be employed in the form of high performance grease after admixture with thickening agents such as micropowders of polytetrafluoroethylene, silica, molybdenum disulfide, and graphite.

EXAMPLES

Materials

All monomers, chain transfer agents, and initiators used in this work are commercially available chemicals. FOMBLIN® and KRYTOX® are trade names for perfluoropolyether lubricating oils manufactured by Solvay-Solexis and DuPont respectively. TEFLON® AF is DuPont's trademark for cotelomers of tetrafluoroethylene with perfluorodimethyldioxole.

Monomers and chain transfer agents used or discussed in the present disclosure and Examples include:

TABLE 1

| Abbreviation | Chemical Name | Formula | Source |
|---|---|---|---|
| HFP | Hexafluoropropylene | $CF_3CF{=}CF_2$ | DuPont |
| TFE | Tetrafluoroethylene | $CF_2{=}CF_2$ | DuPont |
| VF2 | Vinylidene Fluoride | $CF_2{=}CH_2$ | Aldrich |
| PPVE | Perfluoropropyl Vinyl Ether | $CF_2{=}CFOCF_2CF_2CF_3$ | DuPont |
| PFBE | Perfluorobutylethylene | $CH_2{=}CHCF_2CF_2CF_2CF_3$ | DuPont |
| TFP | 3,3,3-Trifluoropropylene | $CH_2{=}CHCF_3$ | Great Lakes |
| E | Ethylene | $CH_2{=}CH_2$ | Matheson |
| Ethane | Ethane | $CH_3CH_3$ | Matheson |
| HFB | Hexafluorobenzene | $C_6F_6$ | DuPont |
| C8H10 | p-xylene | $CH_3{-}C_6H_4{-}CH_3$ | Aldrich |
| C4H10O | Diethyl ether | $CH_3CH_2OCH_2CH_3$ | Aldrich |
| PFBI | Perfluorobutyliodide | $CF_3CF_2CF_2CF_2I$ | DuPont |
| C8H24Si2O2 | Octamethyltrisiloxane | $(CH_3)_3SiOSi(CH_3)_2OSi(CH_3)_3$ | Aldrich |
| HFIB | Hexafluoroisobutylene | $(CF_3)_2C{=}CH_2$ | DuPont |
| PMVE | Perfluoromethylvinyl ether | $CF_3OCF{=}CF_2$ | DuPont |

Test Methods

Viscosity

Kinematic viscosities were determined by the American Society for testing and Materials (ASTM) Test Method D 445-97, "Standard Test method for Kinematic Viscosity of Transparent and Opaque Liquids (the calculation of Dynamic Viscosity)".

Molecular Weight

Size exclusion chromatography was performed using an Alliance 2690 Size Exclusion Chromatograph fitted with a Model 410 refractive index detector (DRI) (Waters Corporation, Milford, Mass. with a Waters 410 refractive index detector (DRI) Data was analyzed using Empower Pro software. Two PL Gel Mixed C and one PL Gel 500 Å columns from Polymer Laboratories Amherst, Mass. were used for separation. Unstabilized THF was used as the mobile phase. The chromatographic conditions were 40° C., flow rate: 1.00 mL/min., injection volume: 100 microL, run time: 35 min.

The samples were prepared at room temperature with moderate agitation by dissolution for 4 h in the THF. The columns were calibrated using a set of 10 narrow polydispersity (<1.1) polystyrene (PS) standards with peak molecular weights from 580 through 7,500,000 fromco-telomer Laboratories.

Telomerization Apparatus

A schematic drawing of the co-telomerization apparatus employed herein is shown in FIG. 1.

The HFP and other monomers were combined with ethane chain transfer agent and initiator in a 1 gallon autoclave, 1, where they formed a liquid phase, 1*b*, and a gas phase, la, under autogenous pressure. Using a high pressure pump, 2, the reactants were cycled from the autoclave, 1, through pressurized tubing, 3, through a 15,500 psi backpressure regulator, 4, and back to the autoclave. A bleeder line, 5, flow-controlled by a needle valve, 6, was adjusted to allow the flow of reactants at ca. 10 cc/sec through a heated stainless steel tubular reactor, 7, with a 0.406 inner diameter heated to ca. 225° C. 400° C. depending upon the specific conditions of reaction, and through a second backpressure regulator, 8, set at 14,000 psi. The pressure was let down as the product flowed into a collector, 9, forming a liquid phase of product and a gas phase of unreacted monomer. The unreacted monomer was passed via a vent line, 10, through a gas flow meter, 11, and vented, 12. Not shown is a NaOH scrubber which was disposed in the vent line upstream from the flow meter for removing acidic reactant residues.

Example 1

The autoclave, 1, was evacuated. Still under vacuum, 50.4 g of liquid perfluorobutylethylene was introduced into the autoclave. 10 grams of gaseous ethane were introduced into the autoclave from a weighed cylinder. 90 g of vinylidene fluoride were introduced into the autoclave from a weighed $VF_2$ cylinder. The lines leading to the autoclave were then pressurized to 415 psig with $NF_3$ and then sealed off, trapping about 2 g of $NF_3$ (25 ml of $NF_3$ at 415 psig). Excess $NF_3$ was vented from the remaining lines. 2000 g of HFP was introduced into the autoclave from a weighed HFP cylinder thereby sweeping the ~2 g of $NF_3$ trapped in the lines into the autoclave.

The contents of the autoclave were mechanically stirred. Throughout the run, liquid phase reactant mixture was continuously pumped, 2, off the bottom of the autoclave passed through the 15,500±100 psi backpressure regulator, 4, and returned to the autoclave 1. Micrometering value, 6, was cracked open, to allow a flow rate of 10 cc/min as indicated on the flow meter, 11. The Foxboro Model IFOA flow meter, 11, had previously been calibrated using pure HFP. The reaction mixture was thereby introduced into the reactor, 7. After a residence time of about 1 minute, the reaction stream was fed through back pressure regulator, 8, set at 14,000±100 psi. The line immediately upstream of the reactor, 7, was electrically heated to 200° C. The reaction stream was then let back down to atmospheric pressure as it exited back pressure regulator, 8. The unreacted gases that flashed off from product collector 9 were scrubbed by bubbling through 5% aqueous NaOH through the scrubber (not shown) in the line, 10, between collector 9 and flowmeter 11 on their way to being vented, 12.

Less volatile product remained behind in the collector 9.

The reaction was run until the liquid phase in the autoclave 1, was largely depleted as indicated by a decrease in pressure to less than 15,500 psi in the monomer recycle loop. The reaction was terminated after 148 minutes, during which the flow meter 11, indicated a flow of 955 grams of unreacted monomer. 758 g of dark brown fluid was recovered from collector 9. The 955 g of unreacted monomer off gases plus the 758 g of fluid recovered from the collector accounted for 1713 g of starting materials, corresponding to an average flow rate through the reactor of ~11.6 g/min with an average residence time in the reactor of 1 minute (based on an assumption that the reactants had a density of ~1 g/cc at 14,000 psi and 375° C.). Conversion of reactor feed to crude product was 34%. Productivity was 260 lbs/gallon/hr calculated on the basis of 758 g of crude product.

Product Work Up and Characterization

The 758 g of crude product was transferred to a glass flask and distilled into two fractions. A first fraction was collected after distillation up to 100° C. at atmospheric pressure. The second fraction was also collected up to 100° C. but under a pressure of 1 torr. The properties of the two distillate fractions and the pot residue are given in Table 2. Running the oligomerization for 148 minutes to make 270 g of oil corresponds to productivity for oil production of 91 lbs/gallon/hr. Carbon hydrogen analysis of the two distillate fractions and the oil were consistent with a composition of 93% HFP/3% $VF_2$/2% PFBE/1% ethane for Distillate Fraction #1; 75% HFP/31% $VF_2$/4% PFBE/3% ethane for Distillate Fraction #2, and 32% HFP/48% $VF_2$/17% PFBE/3% ethane for the Residual Oil.

TABLE 2

| Property Measured | Distillate Fraction #1 | Distillate Fraction #2 | Residual Oil |
|---|---|---|---|
| Weight | 89 g | 272 g | 270 g |
| Color | Colorless | Light Yellow | Brown |
| Molecular Weight by GPC vs. Polystyrene | Mw 140<br>Mn 120 | Mw 290<br>Mn 240 | Mw 1560<br>Mn 590 |
| Carbon/Hydrogen Analysis | 24.23% C<br>0.27% H | 26.71% C<br>0.45% H | 29.72% C<br>1.11% H |
| Viscosity @ 40° C. | — | — | 117.0 cSt |
| Viscosity @ 100° C. | — | — | 15.1 cSt |
| Solubility of 58.2/41.8 wt % Poly(HFP/TFE), $n_{inh}$ = 0.47 | Clear viscous solution | Swells but does not dissolve | — |
| Solubility of TEFLON AF 1601 | Partial viscous solution | Clear viscous solution | — |

Example 1A

A series of #51200 stainless steel ball bearings were immersed in the oil prepared in Example 1, Krytox®, and Fomblin®, heated for 24 hours at different temperatures, and then visually inspected for corrosion. Corrosion was evaluated subjectively on a 1-5 scale, where 1 corresponded to a shiny ball-bearing surface with no evidence of corrosion, 2 corresponded to some discoloration and pitting; 3 corresponded to pitting on about half of surface; 4 corresponded to pitting on most of the surface; and, 5 corresponded to hazy oil and the ball completely pitted. Results are shown in Table 3.

TABLE 3

| Corrosion Ratings | | | | | |
|---|---|---|---|---|---|
| | Heating Temperature | | | | |
| Oil Tested | 200° C. | 220° C. | 240° C. | 260° C. | 280° C. |
| FOMBLIN ® YL | 2 | 3 | 4 | 5 | — |
| KRYTOX ® 1514 | 2 | 3 | 4 | 5 | — |
| Oil from Example 1A | 2 | 2 | 3 | 3 | 4 |

Examples 2-23

Comparative Examples A-D

Oligomerizations were run using the equipment and methods of Example 1. 2000 g of HFP were employed in all Examples and Comparative Examples.

Any deviations from the conditions of Example 1 are noted in Table 4. In a number of examples a 5 cc tubular reactor was used rather than the 10 cc reactor of Example 1. This had the effect of pushing residence times in the tubular reactor towards 10 to 15 seconds. Even at 10-15 second residence times productivities for total product still approached 500 lbs/gallon/hr (60 kg/liter/hour). Pressures in the tubular reactor were occasionally decreased from 14,000 psi to 8,000 (Example 8) or 10,000 psi (Examples 6, 9, 18), again without drastic decreases in productivity. In Example 5, the starting reaction mixture was diluted down with carbon dioxide. In many examples, the vacuum distillation was taken to 150-200° C. in the process of isolating the oil fraction. In Example 10 di-t-butylperoxide was injected immediately ahead of the tubular reactor starting at a rate of ~0.04 ml/minute and increasing in steps over the course of the run to 0.33 ml/minute. In Example 23, 60 ml of di-t-butylperoxide was mixed with 30 ml of CF3CFHCFHCF2CF3. This mixture was injected into the line immediately ahead of the 5 cc tubular reactor at a rate of ~0.17 ml/minute.

The quantities of initiator and monomer reactants were either weighed in or calculated on the basis of the temperature, pressure, and volume of the addition segment and autoclave respectively. These locations are discharged to the reactor, but the transfer is not quantitative. Thus amounts of nitrogen trifluoride and monomer reactants as described in the Examples are approximate.

In Examples 10 and 23, DTBP indicated under the $NF_3$ column indicates that di-t-butyl peroxide was employed in place of $NF_3$.

In Table 4, the weight of $NF_3$ initiator introduced into the autoclave, 2, shown in FIG. 1, is calculated using the ideal gas law, PV=nRT where P is the $NF_3$ pressure in the make-up section, 1, shown in FIG. 1, and V is the volume of the make-up segment.

Raw yield was simply the weight of all fluid product or solid co-telomer in grams removed from the collector, 7, shown in FIG. 1. The reactor productivity shown in the last column in lb/gal/hr refers to the oil fraction only.

Example 24

The monomers along with a trace of nitrogen trifluoride were compressed to 103 MPa and bled through a tubular reactor maintained at 300° C. and 96.5 MPa. After a 1 minute residence time, a solution of telomer in a supercritical monomer phase was withdrawn from the back end of the reactor. The solution thus withdrawn was reduced to atmospheric pressure and the telomeric residue collected and devolatilized.

A 25 ml loop off the feed line to a 3.8 liter stirred autoclave was filled with 440 psig of nitrogen trifluoride. The 3.8 liter autoclave was then filled via the feed line with 60 g of tetrafluoroethylene, 2000 g of hexafluoropropylene, 20 grams of vinyl fluoride, and 20 g of ethylene, using a portion of the hexafluoropropylene to blow the nitrogen trifluoride into the autoclave. The liquid monomer phase was pumped off the bottom of the autoclave, pressurized to 103 MPa, and then recirculated back to the autoclave. After at least 10 minutes of such recirculation, monomer was bled off the recirculation loop at 10 to 12 grams/minute though a 225° C. preheated line to a 10 cc reactor maintained at 96.5 MPa and 300° C., followed by collection at atmospheric pressure. Flow rate through the reactor was ca. 10-12 g/min. Over a period of 120 minutes about 1300 g of monomer were passed through the reactor. Letting the reaction mixture back down to atmospheric pressure gave a yellow, foamy fluid that was allowed to first evaporate down overnight and then dried further overnight in a 150° C. vacuum oven. This gave 176 g of a highly viscous fluid having an inherent viscosity of 0.067 in $CF_3CFHCFHCF_2CF_3$ solvent at 25° C. The composition was found by NMR to be 12.7 mole % vinyl fluoride, 38.6 mole % hexafluoropropylene, 23.0 mole % ethylene, 25.7 mole % tetrafluoroethylene. The glass transition temperature was −10° C. as determined by differential scanning calorimetry in the second heating at 10° C./min heating rate in nitrogen.

TABLE 4

| Example # | Reactor (cc)/ Pressure (kpsi) | TFE (g) | $VF_2$ (g) | Other Monomers | Chain Transfer Agent | $NF_3$ (g) | ° C. | Yield (g) | Product & Comments |
|---|---|---|---|---|---|---|---|---|---|
| 1 | 10/14 | | 90 | 50 g C4F9CH═CH2 | 10 g Ethane | 2 | 375 | 758 | Brown Oil, 117 cSt @40° C. 91 lb/gal/hr |
| 2 | 5/14 | | 90 | 97.5 g C4F9CH═CH2 | 10 g Ethane | 2 | 375 | 596 | Yellow Oil, 180.5 cSt @ 40° C. 72 lb/gal/hr |
| 3 | 5/14 | | 90 | 200 g C4F9CH═CH2 | 20 g Diethyl Ether | 16 | 275 | 252 | Yellow Oil, 67.6 cSt @ 40° C. 94 lb/gal/hr |
| 4 | 5/14 | | 90 | 200 g C4F9CH═CH2 | 50 ml C4F9I | 8 | 275 | 165 | Purple Oil, 84 cSt @ 40° C. 73 lb/gal/hr |
| 5 | 5/14 | | 90 | 99 g C4F9CH═CH2 | 10 g Ethane | 2 | 350 | 426 | Yellow Oil, 178 cSt @ 40° C. 104 lb/gal/hr |
| 6 | 10/10 | | 90 | | 20 g Ethane | 2 | 375 | 732 | Brown Oil, 767 cSt @ 40° C. 132 lb/gal/hr |
| 7 | 5/14 | | 90 | | 39 g Octamethyl-trisiloxane | 16 | 275 | 392 | Brown Oil, 1285 cSt @ 40° C. 195 lb/gal/hr |
| 8 | 5/8 | | 200 | | 41 g Ether | 8 | 275 | 220 | Yellow Oil, 278.5 cSt @ 40° C. 89 lb/gallon/hr |
| 9 | 10/10 | | 90 | 11 g Ethylene | 10 g Ethane | 2 | 375 | 151 | Black Oil, 1117 cSt @ 40° C. 73 lb/gal/hr |
| 10 | 10/14 | | 90 | | 20 g Ethane | DTBP* | 275 | 336 | Yellow Oil, 1032 cSt @ 40° C. 157 lb/gal/hr |
| 11 | 10/14 | | 90 | 100 g PPVE | 20 g Ethane | 2 | 375 | 875 | Brown Oil, 57.8 cSt @40° C. 92 lb/gal/hr |
| Example # | Reactor (cc)/ Pressure (kpsi) | TFE (g) | VF2 (g) | Other Monomers | Chain Transfer Agent | NF3 (g) | ° C. | Yield (g) | Product & Comments |
| Comp. Ex. D. | 10/14 | | 90 | 102 g PPVE | | 2 | 375 | 510 | Hazy Orange Oil, 11,600 cSt @ 40° C. 78 lb/gal/hr |
| 12 | 5/14 | | 90 | 80 g CF3CH═CH2 | 20 g diethyl ether | 8 | 275 | 337 | Red Oil, 80.2 cSt @ 40° C., 198 lb/gal/hr |

TABLE 4-continued

| | | | | | | | | | | |
|---|---|---|---|---|---|---|---|---|---|---|
| 13 | 5/14 | | 90 | 160 g CF3CH═CH2 | 20 g Diethyl Ether | 8 | 275 | 181 | Yellow Oil, 279 cSt @ 40° C. 58 lb/gal/hr |
| 14 | 5/14 | | 90 | 160 g CF3CH═CH2 | 20 g Diethyl Ether | 16 | 250 | 94 | Brawn Oil, 539 cSt @ 40° C. 34 lb/gal/hr |
| 15 | 5/14 | | 90 | 157 g CF3CH═CH2 | 100 ml C6F6 | 8 | 275 | 205 | Yellow Oil, 1839 cSt @ 40° C. 66 lb/gal/hr |
| 16 | 5/14 | | 90 | 136.4 g CF3CH═CH2 | 50 ml p-xylene | 8 | 275 | 90 | Yellow Oil, 9.1 cSt @ 40° C., 38 lb/gal/hr |
| 17 | 5/14 | | 90 | 41.5 g CF3CH═CH2 | 10 g Ethane | 2 | 300 | 383 | Yellow Oil 845 cSt @ 40° C. 169 lb/gal/hr |
| Comp. Ex. A | 10/14 | 80 | | | | 1 | 275 | 91 | Dryco-telomer 22 lb/gal/hr |
| Comp. Ex. B | 10/14 | 80 | | | | 1 | 275 | 66 | Dryco-telomer |
| 18 | 10/10 | 90 | | 10 g Ethylene, 102 g PPVE | 10 g Ethane | 2 | 375 | 574 | Brown Oil, 183 cSt @ 40° C. 55 lb/gal/hr |
| Comp Ex. C | 10/14 | 80 | | 98 g PPVE | | 2 | 375 | 168 | Yellow Oil, 6755 cSt @40° C. 17 lb/gal/hr |
| 19 | 10/14 | 80 | | 97 g PPVE | 20 g Ethane | 2 | 350 | 418 | Yellow Oil, 319 cSt @40° C. 31 lb/gal/hr |
| 20 | 10/14 | 80 | | 99 g PPVE | 10 g Ethane | 2 | 375 | 340 | Brown Oil, 128 cSt @ 40° C. 43 lb/gal/hr |
| 21 | 10/14 | | | 50 g Ethylene | 20 g Ethane | 2 | 325 | 251 | Brown Oil, 2447 cSt @ 40° C. 33 lb/gal/hr |
| 22 | 5/14 | 90 | | 203 g C4F9CH═CH2 | 16 g Ethane | 8 | 275 | 221 | Yellow Oil, 2690 cSt @ 40° C. 86 lb/gal/hr |
| 23 | 5/14 | 20 | 70 | | 20 g Ethane | DTBP | 275 | 254 | Light Brown Oil, 494 cSt @ 40° C. 127 lb/gal/hr |

What we claim is:

1. An article comprising a metallic surface and anamorphous liquid hydrofluorocarbon co-telomer coatingly contacting said surface, said co-telomer comprising 30-65 mol-% of monomer units derived from hexafluoropropylene and having a H:F molar ratio in the range of 0.05 to 1, and wherein said metallic surface is at a temperature in the range of 200 to 280° C.

2. The article of claim 1 wherein the viscosity of the liquid hydrofluorocarbon ranges from 1 to 10,000 cSt at 40° C.

3. The article of claim 1 wherein the liquid hydrofluorocarbon further comprises monomer units derived from tetrafluoroethylene, vinylidene fluoride, or ethylene.

4. The article of claim 3 wherein the liquid hydrofluorocarbon further comprises one or more monomer units derived from comonomers besides tetrafluoroethylene, vinylidene fluoride, or ethylene, and wherein one of tetrafluoroethylene, vinylidene fluoride, or ethylene is the predominant co-monomer.

5. The article of claim 3 wherein the total of the concentrations of vinylidene fluoride, ethylene, and tetrafluoroethylene is 10 weight % or less.

6. The article of claim 4 wherein the one or more monomer units are derived from one or more olefinically unsaturated comonomers selected from the group consisting of perfluoropropylvinyl ether, perfluoromethylvinyl ether, perfluoroisopropylvinyl ether, hexafluoroisobutylene, perfluorobutylethylene, 3,3,3-trifluoropropene, vinyl fluoride, and trifuoroethylene.

7. The article of claim 4 wherein the olefinically unsaturated co-monomer is ethylene at a concentration of ≦3 weight-%.

8. The article of claim 1 wherein the metallic surface is stainless steel.

9. A method for lubricating a metallic surface at high temperature comprising depositing a coating on a metallic surface, and heating said surface to a temperature in the range of 200 to 280° C., wherein said coating comprises an amorphous liquid hydrofluorocarbon co-telomer comprising 30-65 mol-% of monomer units derived from hexafluoropropylene and having a H:F molar ratio in the range of 0.05 to 1.

10. The method of claim 9 wherein the viscosity of the liquid hydrofluorocarbon ranges from 1 to 10,000 cSt at 40° C.

11. The method of claim 9 wherein the liquid hydrofluorocarbon further comprises monomer units derived from tetrafluoroethylene, vinylidene fluoride, or ethylene.

12. The method of claim 11 wherein the liquid hydrofluorocarbon further comprises one or more monomer units derived from comonomers besides tetrafluoroethylene, vinylidene fluoride, or ethylene, and wherein one of tetrafluoroethylene, vinylidene fluoride, or ethylene is the predominant co-monomer.

13. The method of claim 11 wherein the total of the concentrations of vinylidene fluoride, ethylene, and tetrafluoroethylene is 10 weight % or less.

14. The method of claim 12 wherein the one or more monomer units are derived from one or more olefinically unsaturated comonomers selected from the group consisting of perfluoropropylvinyl ether, perfluoromethylvinyl ether, perfluoroisopropylvinyl ether, hexafluoroisobutylene, perfluorobutylethylene, 3,3,3-trifluoropropene, vinyl fluoride, and trifuoroethylene.

15. The method of claim 12 wherein the olefinically unsaturated co-monomer is ethylene at a concentration of ≦3 weight-%.

16. The method of claim 9 wherein the metallic surface is stainless steel.

17. The method of claim 9 wherein the step of coating the metallic surface preceeds the step of heating the surface to a temperature in the range of 200-280° C.

* * * * *